United States Patent [19]

Orillard

[11] Patent Number: 5,039,830

[45] Date of Patent: Aug. 13, 1991

[54] DEVICE FOR MANUAL CONTROL BY DRIVING A ROTATING BUTTON

[75] Inventor: Francis Orillard, Saint Ouen L'Aumone, France

[73] Assignee: Thomson CSF, Paris, France

[21] Appl. No.: 477,912

[22] PCT Filed: Sep. 15, 1989

[86] PCT No.: PCT/FR89/00474

§ 371 Date: May 1, 1990

§ 102(e) Date: May 1, 1990

[30] Foreign Application Priority Data

Sep. 23, 1988 [FR] France ..... 88 12471

[51] Int. Cl.[5] ..... H01H 19/60

[52] U.S. Cl. ..... 200/61.39; 200/336; 200/291; 74/553

[58] Field of Search ..... 74/491, 504, 528, 548, 74/552, 553; 200/11 R, 11 TW, 61.39, 302.1, 322.2, 336, 279, 291, 293, 294, 296

[56] References Cited

U.S. PATENT DOCUMENTS

| | | | |
|---|---|---|---|
| 1,664,624 | 4/1928 | Heichen . | |
| 2,993,972 | 7/1961 | Stewart . | |
| 3,975,601 | 8/1976 | Whelan | 200/61.39 |
| 4,594,483 | 6/1986 | Rosl | 200/61.39 |
| 4,955,253 | 9/1990 | Sakai | 74/553 |

FOREIGN PATENT DOCUMENTS

| | | | |
|---|---|---|---|
| 294963 | 11/1916 | Fed. Rep. of Germany . | |
| 3543652 | 6/1987 | Fed. Rep. of Germany . | |
| 538849 | 12/1920 | France . | |
| 1022327 | 3/1953 | France | 200/61.39 |

*Primary Examiner*—Gerald P. Tolin

*Attorney, Agent, or Firm*—Cushman, Darby & Cushman

[57] ABSTRACT

The device is designed to be housed within the body of a control button. It comprises two coaxial ratchet wheels (7, 8) mounted in such a way as to present oppositely directed internal circular toothings; a contact strip (4, 5) is associated with each wheel. The contact strips are driven by the rotation of the button (1) by way of a mechanical axle (2, 10, 11) on which they are friction mounted. For one direction of rotation of the axle one of the strips slips on the teeth of the wheel with which it is associated, creating intermittent breaks in the strip-wheel electrical connection on crossing from one tooth to the next, while the other strip, which is locked by the toothing of the associated wheel and slips on the axle, remains in permanent electrical contact with the ratchet wheel with which it is associated. If the direction of rotation is reversed, the role of the strips is reversed.

Application to the creation of pulses by intermittent breaking of a D.C. voltage with the aid of strips and to the discrimination of the direction of rotation of the axle.

2 Claims, 3 Drawing Sheets

DEVICE FOR MANUAL CONTROL BY DRIVING A ROTATING BUTTON

Figure 1:
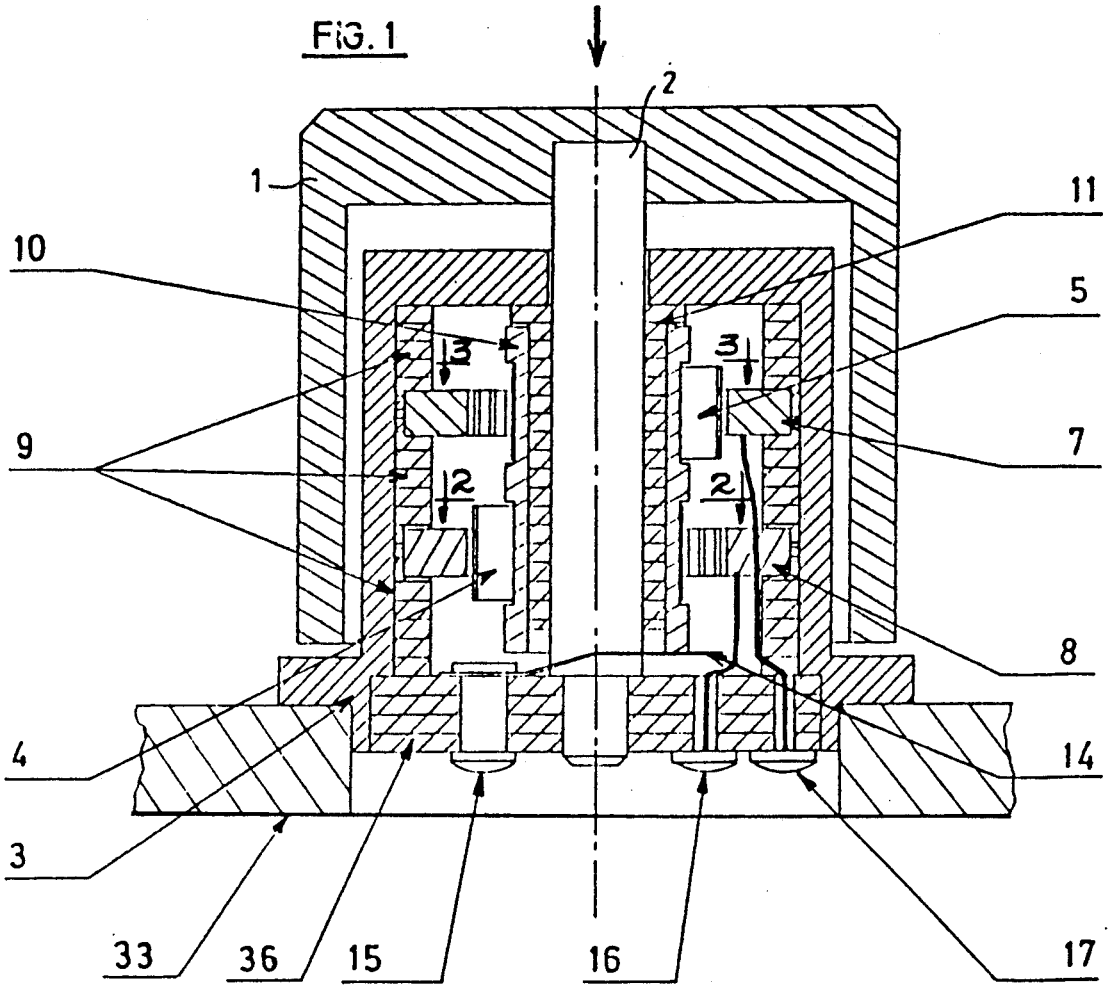

The present invention relates to a device for manual control by driving a rotating button.

Certain items of equipment, in particular in the military and avionics fields, have to be highly compact and of low weight and the design which results from this is such that the incorporation of a rotary control button, generally on a front face, presents difficulties, if not being impossible.

In fact, a manual control button generally comprises a mechanical axle which is at one end driven by the rotation of the button and whose other end drives a part in such a way as to produce the desired control. In this common type of implementation the control button is next to the panel on which it is mounted, the mechanical axle passing through the panel, the part driven by the axle lying on the other side of the panel relative to the button.

In the well-known case of a potentiometer for example, the driven part is the potentiometer slider and the rotation of the button is conveyed via an extracted variable-level electrical signal between the slider and one end, itself connected to a reference potential.

The invention is intended for such cases and an example of a corresponding application is described below which relates to, more particularly, an apparatus for visualization on a flat screen, this apparatus possibly constituting an item of hardware on board an aircraft. The use, for such an apparatus, of a box which tightly follows the shape of the screen does not allow much room for a classical control body with mechanical axle to pass, whence the need for another solution.

The aim of the invention is to resolve such problems by reducing the volume of the control device to essentially that taken up simply by the control button in front of the panel.

The invention proposes a device for manual control by driving a rotating button, mounted on a support and comprising the button, an axle integral with the button and controlled in rotation by the button, a given assembly, formed by a fixed ratchet wheel, coaxial with the axle, with internal toothing, an electrical contact mounted on the axle and provided with at least one conducting strip forming a ratchet for the ratchet wheel and being locked by the toothing of the ratchet wheel for a given direction of rotation of the axle and slipping on the toothing for the direction of rotation of the axle opposite to the given direction, and electrical access connected respectively to the axle and to the wheel, and in which the mechanical connection which passes from the wheel to the axle via the support, is electrically insulating, characterized in that the contact is mounted in such a way as to slip on the axle when it is locked by the ratchet wheel and in that the device comprises an inverse assembly formed from a ratchet wheel and a contact, mounted on the axle, next to the given assembly, in inverse fashion relative to the given assembly, that is to say in a fashion such that the strip forming the ratchet of this inverse assembly is locked for the direction of rotation of the axle inverse to the given direction and slips on the toothing for the given direction of rotation.

Figure 2:
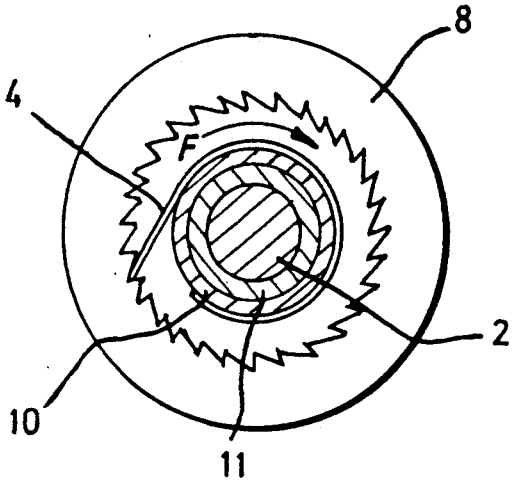
Figure 3:
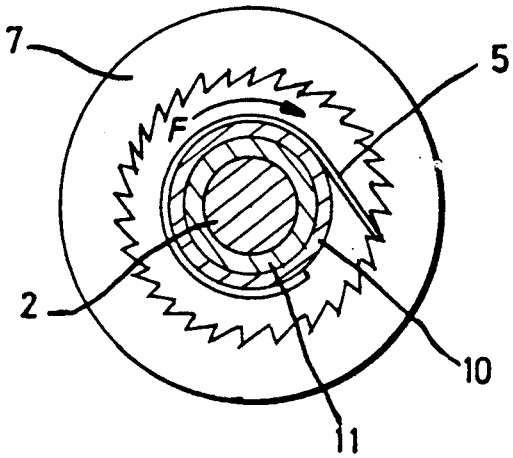
Figure 4:
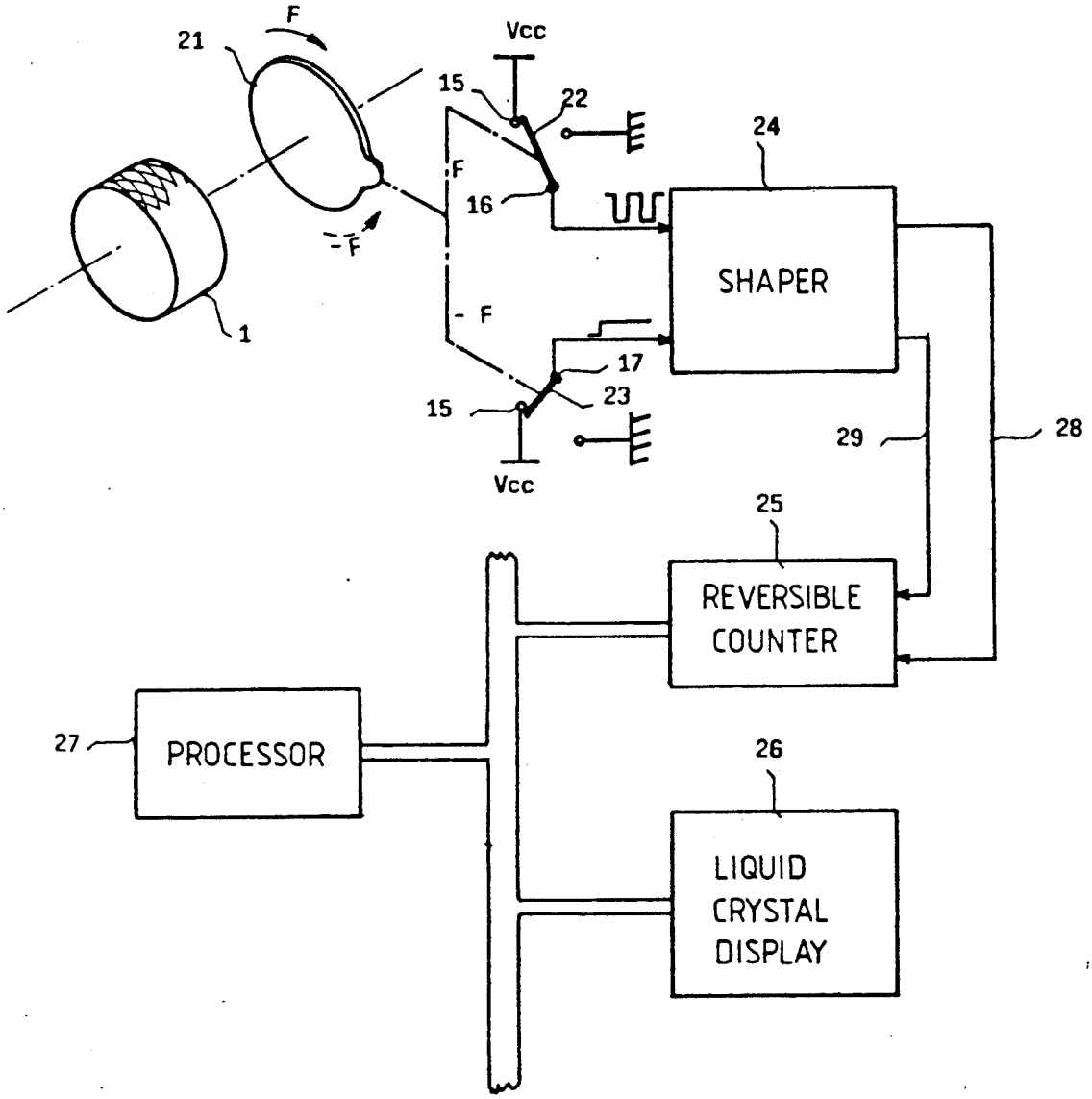
Figure 5:
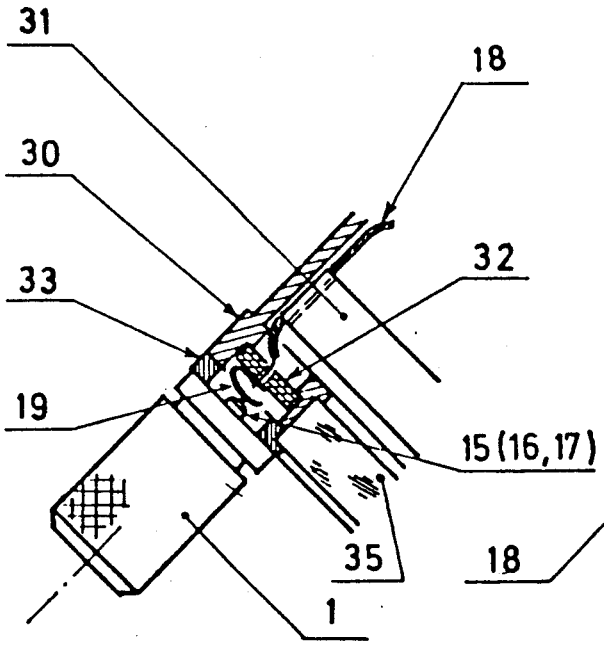
Figure 6:
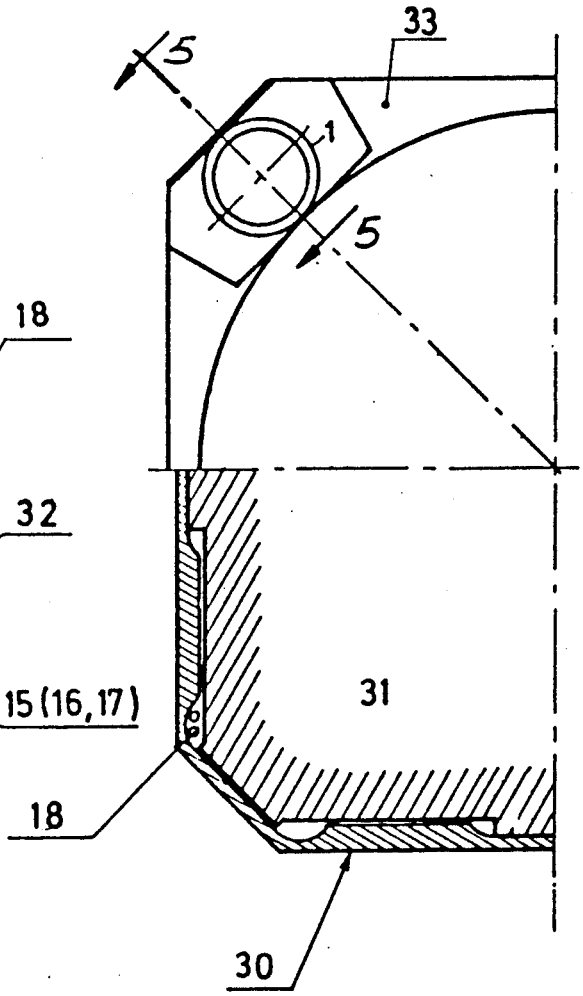

The particular features and advantages of the invention will emerge in the description which follows given by way of example with reference to the attached figures which represent:

FIG. 1, in median section through the axis of rotation, an example of an embodiment according to the invention of a device for manual control by driving a rotating button;

FIGS. 2 and 3, detail diagrams relating to the switch system constituted by the two strips and the associated toothings;

FIG. 4, a diagram of the circuits for exploiting the signals produced by the rotation of the button, in order to produce a corresponding variation signal;

FIGS. 5 and 6, diagrams relating to an example of the use of the invention on an apparatus for visualization using a liquid crystal screen.

FIG. 1 shows a button, 1, which is controlled in manual rotation, by the operator, about the axis of rotation Z..The button 1 has the form of a cylindrical tube element closed at its upper end. A mechanical rotation axle 2 is integral, via one of its ends, with the solid upper portion of the button.

The remaining portion of the device for manual control consists of a mechanical device driven by the axle 2 and elements for electrical connection externally.

The mechanical device is, in its essentials, laid out inside the cylindrical cavity of the button. It comprises a box 3 provided, at its lower portion, with a base plate to ensure its positioning on a support panel attachment 33. Inside the box 3, which includes a perforated portion to allow the mechanical axle 2 to pass through to the upper portion, is an assemblage consisting of two contact strips 4 and 5 and two ratchet wheels 8 and 7 respectively associated with the strips 4,5.

Each of the assemblies 4,8 and 5,7 is shown detailed in cross-section, in FIGS. 2 and 3 respectively. Each wheel comprises an internal toothing on which, for one direction of rotation, one end of the associated strip moves. For the other direction of rotation the end of the associated strip will be engaged by the toothing and locked by the corresponding tooth; this strip thus constitutes a ratchet. The assemblage of the ratchet wheels and strips is reversed in FIGS. 2 and 3 in such a way that, for one direction of rotation of the axle 2, for example the direction F, the strip 4 successively slips in the internal circular toothing carried by the wheel 8. In contrast, in the case of the other assemblage, the strip 5 is locked by the internal toothing of the wheel 7. The wheels 8 and 7 are fixed, made integral with the box 3 by bracings 9 of cylindrical shape ensuring the positioning of the wheels in their peripheral portion on the box-side. The strips have a spiral shape composed of a single turn with a cylindrical axial portion forming one end and wrapping round the rotation axle, and a rectilinear end-portion which bears against the toothing. The cylindrical portion of the strips 4 and 5 does not rest directly on the mechanical axle 2 but by way of a first cylindrical part 10 on which they are friction mounted; this part 10 ensures their mechanical positioning along the axis Z. The axle 2 and the part 10 are metal and an insulating sleeve 11 is interposed between these two parts which are integral with the rotation axle 2 and driven in rotation with this axle in one direction or the other under the control of the button 1. The strips 4 and 5 are friction mounted on the part 10, and for a given direction of rotation of axle 2, one of the strips, 4, is driven by the part 10, whilst the other strip, which is locked, allows the rotation of the part 10 with negligible friction, and inversely for the other direction of rotation.

The device comprises electrical connections respectively linking the two strips 4 and 5, by way of the collector 10 and an elastic strip 14, to a common terminal 15 and the two ratchet wheels 7 and 8 which are made of conducting material, to two other terminals 16 and 17. The terminals or pins 15, 16 and 17 are situated on the lower portion of the button and emerge at a perforated portion of the panel 33 on which the button is mounted. The electrical connection terminals are made integral with the box by way of a base plate 36 on which the other end of the mechanical axle 2 terminates.

The button 1 drives the mechanical axle 2, which drives the strip 4 along the toothing of the wheel 8 for one direction of rotation, and for the other direction of rotation the strip 5 along the toothing of the wheel 7; it follows from this that if the common point 15 is connected to a D.C. voltage, the signal provided at the outputs 16 and 17 is made up of a chopped signal for the one and continuous for the other, and inversely on changing the direction of rotation. The chopping arises from that strip of the two strips 4, 5 which slips on the toothing and momentarily breaks its electrical contact with the wheel with which it is associated during the passage from one tooth to the next. This difference in the signals is put to good use in order to distinguish the direction of rotation which has been manually imposed on the axle 2 by control of the button 1 and in order to produce the desired variation. The latter results directly from the angular magnitude of the rotation and hence from the number of electrical transitions picked up on the corresponding signal. In the example illustrated, the connection between the contact strips and the terminal 15 is effected by way of an elastic strip 14 at the lower portion of the collector. The strip 14 rubs against the bottom of the collector 10 and allows electrical connection between the collector 10 and the common contact 15.

The control device allows housing of a rotary pulse generator device, with direction of rotation discrimination, within the space usually allocated to a single control button.

FIG. 4 illustrates the circuit electrically connected to the terminals 15 to 17. The assembly formed by the two ratchet wheels 7, 8 the strips 5,4 and the driving device for the two strips, is represented by a cam 21 and two switches 22 and 23. For the direction of rotation F it is supposed that the switch 22 is actuated on each crossing of a toothing, whilst the switch 23 remains in the position shown connecting it to a common wire, that is to say to a D.C. voltage $V_{cc}$ applied to the terminal 15. The output signals extracted at 16 and 17 are transmitted to a pulse shaper circuit 24 before being applied to a reversible counter circuit 25. The output of the reversible counter is carried away to the exploitation circuits. In the case of the envisaged application, the actuation of the button is intended to act on a visualization on a flat liquid crystal screen 26. The system is managed by a programmed processor 27 connected to the counter 25 and to the display device 26 by way of a bus in order to regulate the brightness of the display. Depending on the path providing the pulses, the processor 27 determines a corrective action to be applied, in one direction or the other, to the visualization device 26. Depending on the magnitude of the angular rotation of the button and hence of the pulse count, the processor 27 controls a magnitude or level variation corresponding to the parameter to be modified.

FIGS. 5 and 6 refer to this type of application and are detail drawings of an implementation. FIG. 5 shows the assemblage of the rotation control device according to FIG. 1, outside the front face of the display device, as well as the lack of room between the useful internal profile of the box 30 and the external profile of the liquid crystal panel 31 protected by a window 35. This lack of room makes impossible the incorporation of a classical mechanical connection between an external control button 1 and a controlled body positioned inside. However, the small space available allows the passage of electrical connections 18.

The box 30 is internally machined so as to allow the assemblage of the liquid crystal 31. Its front face is recessed to receive a printed circuit 32 supplied with three contact strips of which one, 19, is illustrated. The strips are connected through the corresponding wires 18 to the downstream exploitation circuit and ensure, through a front frame 33 on which the button is placed, the connection with the contact pins 15, 16 and 17 of the pulse emitting button.

For a clockwise rotation F of the button 1, the contact 22 (FIG. 4) is intermittently open whilst the contact 23 remains continually closed. The pulses produced are shaped then, via the connection 28, are applied to the reversible counter register 25. For the other direction of rotation, the pulses produced are transmitted via the connection 29 to the reversible counter circuit 25. The processor 27 implements the resetting to zero or reinitialization of the counter before each count.

I claim:

1. Device for manual control by driving a rotating button, mounted on a support and comprising the button, an axle integral with the button and controlled in rotation by the button, a given assembly, formed by a fixed ratchet wheel, coaxial with the axle, with internal toothing, an electrical contact mounted on the axle and provided with at least one conducting strip forming a ratchet for the ratchet wheel and being locked by the toothing of the ratchet wheel for a given direction of rotation of the axle and slipping on the toothing for the direction of rotation of the axle opposite to the given direction, and electrical access connected respectively to the axle and to the wheel, and in which the mechanical connection which passes from the wheel to the axle via the support, is electrically insulating, characterized in that the contact is mounted in such a way as to slip on the axle (2, 10, 11) when it is locked by the ratchet wheel (8) and in that the device comprises an inverse assembly formed from a ratchet wheel (7) and a contact (5), mounted on the axle, next to the given assembly, in inverse fashion relative to the given assembly, that is to say in a fashion such that the strip forming the ratchet of this inverse assembly is locked for the direction of rotation of the axle inverse to the given direction and slips on the toothing for the given direction of rotation.

2. Device for manual control according to claim 1, characterized in that the wheels of the assemblies are conducting, at least insofar as their internal toothing is concerned, with the result that, during rotation of the button (1), the wheel-contact electrical connection of a single assembly is broken only when the strip of the contact under consideration passes from one tooth to another of the toothing of the wheel under consideration.

* * * * *